US009435613B2

(12) United States Patent
Caplan

(10) Patent No.: US 9,435,613 B2
(45) Date of Patent: Sep. 6, 2016

(54) SEMI-ACTIVE LASER SEEKER SYNCHRONIZATION

(71) Applicant: Rosemount Aerospace Inc., Burnsville, MN (US)

(72) Inventor: William Caplan, Northfield, MN (US)

(73) Assignee: Rosemount Aerospace Inc., Burnsville, MN (US)

( * ) Notice: Subject to any disclaimer, the term of this patent is extended or adjusted under 35 U.S.C. 154(b) by 116 days.

(21) Appl. No.: 14/170,773

(22) Filed: Feb. 3, 2014

(65) Prior Publication Data

US 2015/0253111 A1 Sep. 10, 2015

Related U.S. Application Data

(60) Provisional application No. 61/870,876, filed on Aug. 28, 2013.

(51) Int. Cl.

| | |
|---|---|
| ***F41G 7/22*** | (2006.01) |
| ***F41G 7/00*** | (2006.01) |
| ***F41G 3/14*** | (2006.01) |

(52) U.S. Cl.

CPC ..... *F41G 7/22* (2013.01); *F41G 3/145* (2013.01); *F41G 7/007* (2013.01); *F41G 7/226* (2013.01); *F41G 7/2293* (2013.01)

(58) Field of Classification Search

CPC ..... F41G 7/20; F41G 7/22; F41G 7/2246; F41G 7/226; F41G 7/2266; F41G 3/14; F41G 3/145; F41G 7/2273; F41G 7/2293; F41G 7/007; G01S 7/48; G01S 7/495; F42B 15/01

USPC ..... 244/3.1, 3.15–3.19, 3.11–3.14; 342/61, 342/62

See application file for complete search history.

(56) References Cited

U.S. PATENT DOCUMENTS

| | | | | |
|---|---|---|---|---|
| 3,743,216 | A * | 7/1973 | Salonimer | 244/3.16 |
| 3,876,308 | A * | 4/1975 | Alpers | 244/3.16 |
| 4,018,405 | A * | 4/1977 | Baker | 244/3.17 |
| 4,091,412 | A | 5/1978 | Salonimer | |
| 4,100,545 | A * | 7/1978 | Tabourier | 244/3.14 |
| 4,216,472 | A * | 8/1980 | Albanese | 244/3.14 |
| 4,338,602 | A * | 7/1982 | Roeder et al. | 342/62 |
| 5,435,503 | A * | 7/1995 | Johnson et al. | 244/3.15 |
| 6,926,227 | B1 * | 8/2005 | Young et al. | 244/3.1 |
| 7,767,945 | B2 * | 8/2010 | Williams | 244/3.16 |
| 8,698,058 | B1 * | 4/2014 | LaPat | 244/3.19 |
| 2009/0078817 | A1 | 3/2009 | Williams | |

FOREIGN PATENT DOCUMENTS

| | | | |
|---|---|---|---|
| JP | 2007003079 | A | 1/2007 |
| JP | 2011252687 | A | 12/2011 |

OTHER PUBLICATIONS

Extended European Search Report for application No. 14181756.9 dated Jan. 22, 2015.

* cited by examiner

*Primary Examiner* — Bernarr Gregory

(74) *Attorney, Agent, or Firm* — Locke Lord LLP; Scott D. Wofsy; Alicia J. Carroll

(57) ABSTRACT

A system for semi-active laser seeker synchronization includes a laser target designator configured to emit a laser pulse signal and a seeker configured to detect the emitted signal from the laser target designator. The laser target designator and the seeker are operatively connected to synchronize the emission of the laser pulse signal and the detection of the seeker.

11 Claims, 2 Drawing Sheets

SEMI-ACTIVE LASER SEEKER SYNCHRONIZATION

CROSS-REFERENCE TO RELATED APPLICATIONS

This application claims the benefit of and priority to U.S. Provisional Patent Application No. 61/870,876 filed Aug. 28, 2013 which is incorporated by reference herein in its entirety.

BACKGROUND OF THE INVENTION

1. Field of the Invention

The present invention relates to optical tracking and imaging systems and, in particular, to optical tracking and imaging systems for guidance.

2. Description of Related Art

Semi-active laser (SAL) detection or tracking systems are used by the military to support precision laser-guided weapons. With a SAL system, a narrow laser beam of energy is produced and transmitted toward a target. The laser radiation is typically generated and transmitted from a laser target designator (LTD) manned by a forward observer, for example. The forward observer directs the laser radiation to the selected target, thereby designating the target. The SAL seeking system of the laser guided weapon, remotely located from the target and designator, can detect the laser radiation reflected as a pulse signal from the target and assists in guiding the weapon to the target.

Typical SAL systems are designed to scan for the laser pulse at the same frequency as the laser is pulsing. Since the laser pulse operates in an asynchronous mode, it has an unknown time shift. It typically takes time for the SAL system to lock onto the laser pulse and it is possible that the short pulses are not detected by sensors of the seeker, e.g. if only few seconds are available for achieving a lock, a lock may not be achieved.

Such conventional methods and systems have generally been considered satisfactory for their intended purpose. However, there is still a need in the art systems and methods that allow for improved guidance, such as reduced locking time. The present disclosure provides a solution for these problems.

SUMMARY OF THE INVENTION

A system for semi-active laser seeker synchronization includes a laser target designator configured to emit a laser pulse signal and a seeker configured to detect the emitted signal from the laser target designator. The laser target designator and the seeker are operatively connected to synchronize the emission of the laser pulse signal and the detection of the seeker. The seeker can be a focal plane array sensor.

In certain embodiments, the laser pulse signal is synchronized to an external clock. The external clock can be a global positioning system, for example. The laser pulse signals can be emitted at predetermined time intervals. A digital signal processor of the seeker can be programmed to search for the laser pulse signal during the predetermined time intervals.

In accordance with certain embodiments, a launch platform is used to synchronize the laser target designator and the seeker, e.g., prior to launch. The laser target designator can emit the laser pulse signal within a predetermined boundary around the target.

A method for semi-active laser seeker synchronization includes emitting a laser pulse signal from a laser target designator, wherein the laser pulse signal is synchronized to an external clock. The method also includes detecting the emitted laser signal with a seeker also synchronized to the external clock.

Another method for semi-active laser seeker synchronization includes using a launch platform to synchronize a laser target designator and a seeker, e.g., prior to launch. A laser pulse signal is then emitted from the laser target designator. The method includes detecting the emitted laser signal with the seeker.

These and other features of the systems and methods of the subject disclosure will become more readily apparent to those skilled in the art from the following detailed description of the preferred embodiments taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, preferred embodiments thereof will be described in detail herein below with reference to certain figures, wherein.

DETAILED DESCRIPTION OF THE PREFERRED EMBODIMENTS

Figure 1:
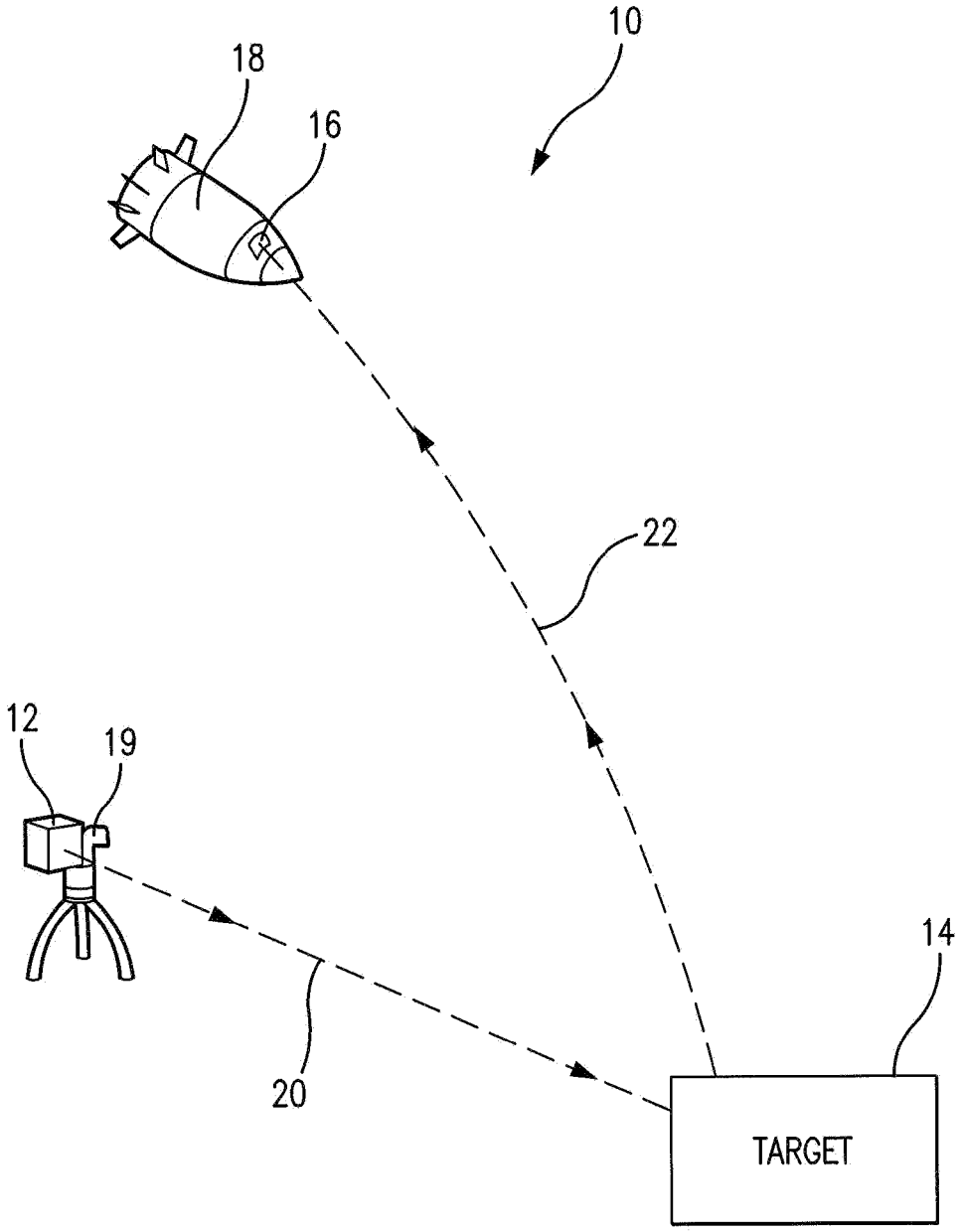
FIG. 1 is a schematic illustration of a semi-active laser guidance system engaging a target.
Figure 2:
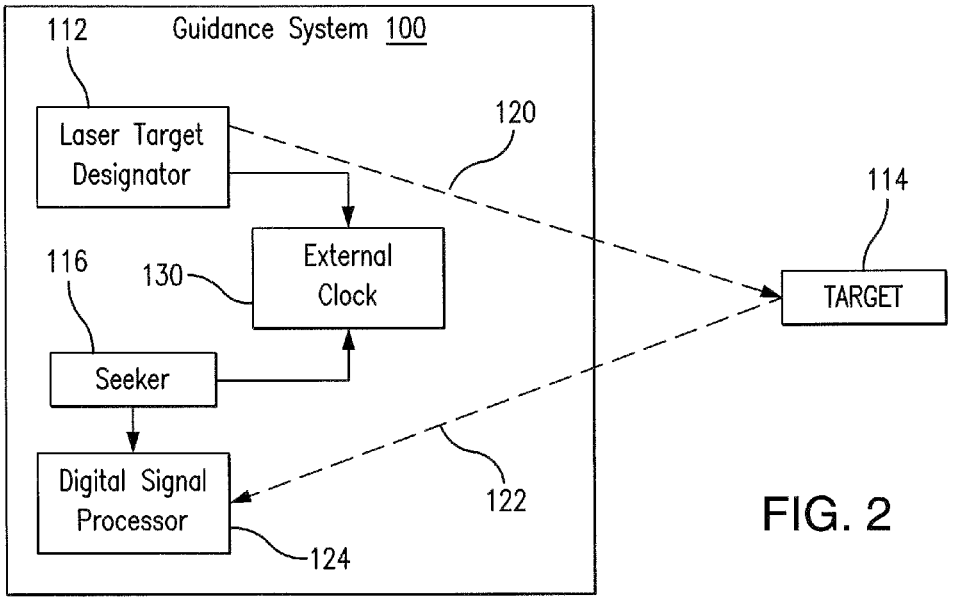
FIG. 2 is a block diagram of an exemplary embodiment of a guidance system constructed in accordance with the present disclosure.

Reference will now be made to the drawings wherein like reference numerals identify similar structural features or aspects of the subject disclosure. For purposes of explanation and illustration, and not limitation, a partial view of an exemplary embodiment of the semi-active laser seeker synchronization in accordance with the disclosure is shown in FIG. 2 and is designated generally by reference character 100. Other embodiments in accordance with the disclosure, or aspects thereof, are provided in FIG. 3, as will be described. The systems and methods described herein can be used provide time synchronization for semi-active laser systems.

In general, semi-active laser (SAL) systems are used in applications where a "man-in-the-loop" capability is preferred to active designation systems that require the weapon to designate the target. Typically, there are two main parts to a SAL system 10, i.e., a laser target designator 12 used to designate a target 14 and a sensing system 16 used to guide a weapon 18 to the designated target 14. During use, the operator 19 of the laser target designator 12 aims laser radiation from the designator 12 towards the target 14. The operator 19 typically pulls a trigger to enable the designator 12 and fire a series of pulse laser signals 20 to place a pulsing laser "spot" on the target. The SAL sensing system 16, typically implemented on ordinance weapons such as missiles, receives the reflected return laser pulses 22 from the target 16, and uses the reflected returns 22 to guide the weapon to the target 14.

With reference to FIG. 2, system 100 reduces the amount of time the sensing system requires to lock onto the target designation compared to traditional guidance system. The system 100, as shown in FIG. 2, includes a laser target designator (LTD) 112 configured to emit a laser pulse signal 120. The LTD 112 may be located on a launch platform of a weapon or it may be located separately, as in a forward observer. Additionally, the LTD 112 may be manually operated, remotely operated and/or autonomously operated. The system 100 having a seeker 116 is configured to detect the emitted signal 122 from the LTD 112. The seeker 116 is any sensor that is sensitive to the laser wavelength and intended to receive the laser pulse signal 122 from the LTD 112. The seeker 116 receives the timing synchronization signal 132 from the external clock 130 typically using a radio receiver channel, for example a global positioning system or similar source.

To time synchronize the LTD 112 and the seeker 116, the LTD 112 is synchronized to an external clock 130. The external clock may be a global positioning system or another suitable clock. The external clock 130 emits timing signals 131, 132 to the LTD 112 and a digital signal processor 124 of the seeker 116. The laser pulse signals 120 are then emitted at the predetermined time intervals towards the target 114. The digital signal processor 124 also synchronized to the external clock 130, detects the pulsed signals at the same predetermined time intervals. This in turn signals the seeker 116 to search for the laser pulse signal 122 during the predetermined time intervals. Programming the emission of the laser signal and detection of the time signal within the same predetermined interval provides time synchronization that reduces the need for seeker 116 to have to determine the phase shift of the signal. This ensures the seeker not only identifies the laser pulse signal but also reduces the amount of time required for the seeker to find the signal.

An exemplary method using guidance system 100 includes emitting a laser pulse signal from the laser target designator, e.g., laser target designator 112, wherein the laser pulse signal, e.g., signal 120, is synchronized to an external clock, e.g., external clock 130. The seeker, e.g., seeker 116, is then used to detect the emitted laser signal, e.g. signal 122, while also synchronized to the external clock. In this embodiment, the laser pulse signals are emitted at predetermined time intervals such that a digital signal processor, e.g., digital signal processor 124, of the seeker is programmed to search for the laser pulse signal during the same predetermined intervals.

Figure 3:
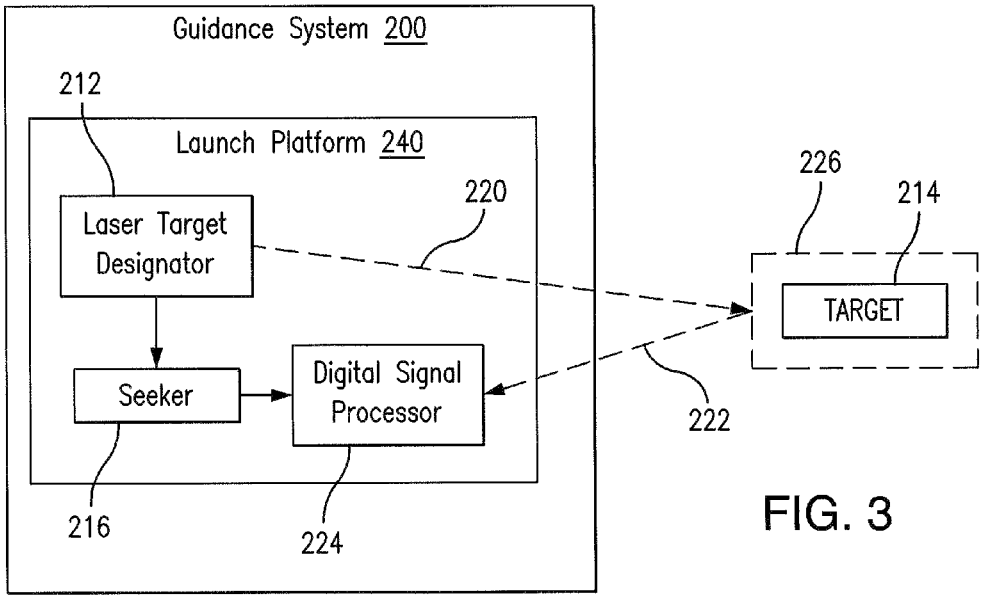
FIG. 3 is a block diagram of another embodiment of the guidance system constructed in accordance with the present disclosure.

With reference now to FIG. 3, system 200 is described herein. The LTD 212 and the seeker 216 are initially located on the launch platform 240. Synchronization between the LTD emission 220 and the digital processing signal 224 of the seeker 216 is communicated through the launch platform 240 prior to launching seeker 216. The LTD 212 and seeker 216 can be located on the same aircraft. Regardless of the positioning of the LTD and seeker, the LTD 212 and seeker 216 are operatively coupled together through the launch platform 240 for prelaunch synchronization. The LTD 212 using a predetermined estimate for range sets a boundary 226 around the target 214 destination. This provides the seeker 216 with a limited time interval to search for the signal 122 therefore reducing the time required by the seeker 216 to acquire the laser signal 122 and lock onto the target 114.

An exemplary method of using guidance system 200 includes using a launch platform, e.g., launch platform 200, to synchronize a laser target designator, e.g., laser target designator 212, and a seeker, e.g., seeker 216. A pulse signal, e.g., signal 220, is then emitted from the laser target designator. The seeker then detects the emitted laser signal, e.g., signal 222. The laser target designator emits the laser pulse signal within a predetermined boundary around a target.

The methods and systems of the present disclosure, as described above and shown in the drawings, provide for a guidance system with superior properties including time synchronization between the designator and sensing system. While the apparatus and methods of the subject disclosure have been shown and described with reference to preferred embodiments, those skilled in the art will readily appreciate that changes and/or modifications may be made thereto without departing from the spirit and scope of the subject disclosure.

What is claimed is:

1. A system for semi-active laser seeker synchronization, the system comprising:

a laser target designator configured to emit a laser pulse signal;

a seeker configured to detect the emitted signal from the laser target designator, wherein the laser target designator and the seeker are operatively connected to synchronize the emission of the laser pulse signal and the detection of the seeker; and a launch platform configured to synchronize the laser target designator and the seeker, wherein, prelaunch, the laser target designator and the seeker are located on the launch platform.

2. The system recited in claim 1, wherein the seeker is a sensor sensitive to the laser energy.

3. The system as recited in claim 1, wherein the laser target designator is configured to emit laser pulse signals at predetermined time intervals.

4. The system as recited in claim 3, wherein a digital signal processor of the seeker is programmed to search for the laser pulse signal during the predetermined time intervals.

5. The system as recited in claim 1, wherein the laser target designator is configured to emit the laser pulse signal within a predetermined boundary around the target.

6. A method for semi-active laser seeker synchronization, the steps comprising:

using a launch platform to synchronize a laser target designator and a seeker, wherein, prelaunch, the laser target designator and the seeker are located on the launch platform;

emitting a laser pulse signal from the laser target designator; and detecting the emitted laser signal with the seeker.

7. The method as recited in claim 6, wherein detecting the emitted laser signal includes detecting the signal with a sensor of the seeker.

8. The method as recited in claim 6, wherein emitting the laser pulse signal includes emitting the laser pulse signal within a predetermined boundary around a target.

9. The method as recited in claim 6, wherein the seeker is a sensor sensitive to the laser energy.

10. The method as recited in claim 6, wherein emitting the laser pulse signal includes emitting the laser pulse signals at predetermined time intervals.

11. The method as recited in claim 10, wherein a digital signal processor of the seeker is programmed to search for the laser pulse signal during the predetermined time intervals.

* * * * *